United States Patent [19]

Engstrom et al.

[11] 4,022,654

[45] May 10, 1977

[54] COUNTERCURRENTLY BLEACHING HIGH CONSISTENCY CELLULOSE PULP WITH OXYGEN

[75] Inventors: Hans-Erik Rye Engstrom; Bengt Edvard Pettersson, both of Sundsvall, Sweden

[73] Assignee: Sunds Aktiebolag, Sundsvall, Sweden

[22] Filed: Apr. 9, 1975

[21] Appl. No.: 566,285

Related U.S. Application Data

[63] Continuation of Ser. No. 414,341, Nov. 9, 1973, abandoned.

[30] Foreign Application Priority Data

July 24, 1970 Sweden ..... 10238/70
Feb. 17, 1971 Sweden ..... 2023/71

[52] U.S. Cl. ..... 162/19; 8/111; 162/24;65

[51] Int. Cl.[2] ..... D21C 9/10

[58] Field of Search ..... 162/65, 100, 17, 19, 162/52, 24, 63, 64, 66, 67; 8/111

[56] References Cited

UNITED STATES PATENTS

| | | | |
|---|---|---|---|
| 3,024,158 | 3/1962 | Grangaard et al. | 162/65 X |
| 3,668,063 | 6/1972 | Engstrom | 162/65 X |
| 3,703,435 | 11/1972 | Schleinkofer | 162/65 X |

FOREIGN PATENTS OR APPLICATIONS

| | | | |
|---|---|---|---|
| 156,397 | 5/1951 | Australia | 162/66 |

*Primary Examiner*—Arthur L. Corbin
*Attorney, Agent, or Firm*—Pierce, Scheffler & Parker

[57] ABSTRACT

Finely disintegrated and fluffed cellulose pulp, at a consistency of 25–35%, is introduced into the top of a reaction tower and countercurrently bleached with oxygen gas, introduced into the lower portion of the tower, at a temperature of 80°–120° C. The pulp is maintained in the tower as a gas permeable column having a maximum height, in meters, equal to five tenths of the pulp consistency.

3 Claims, 12 Drawing Figures

COUNTERCURRENTLY BLEACHING HIGH CONSISTENCY CELLULOSE PULP WITH OXYGEN

Figure 1:
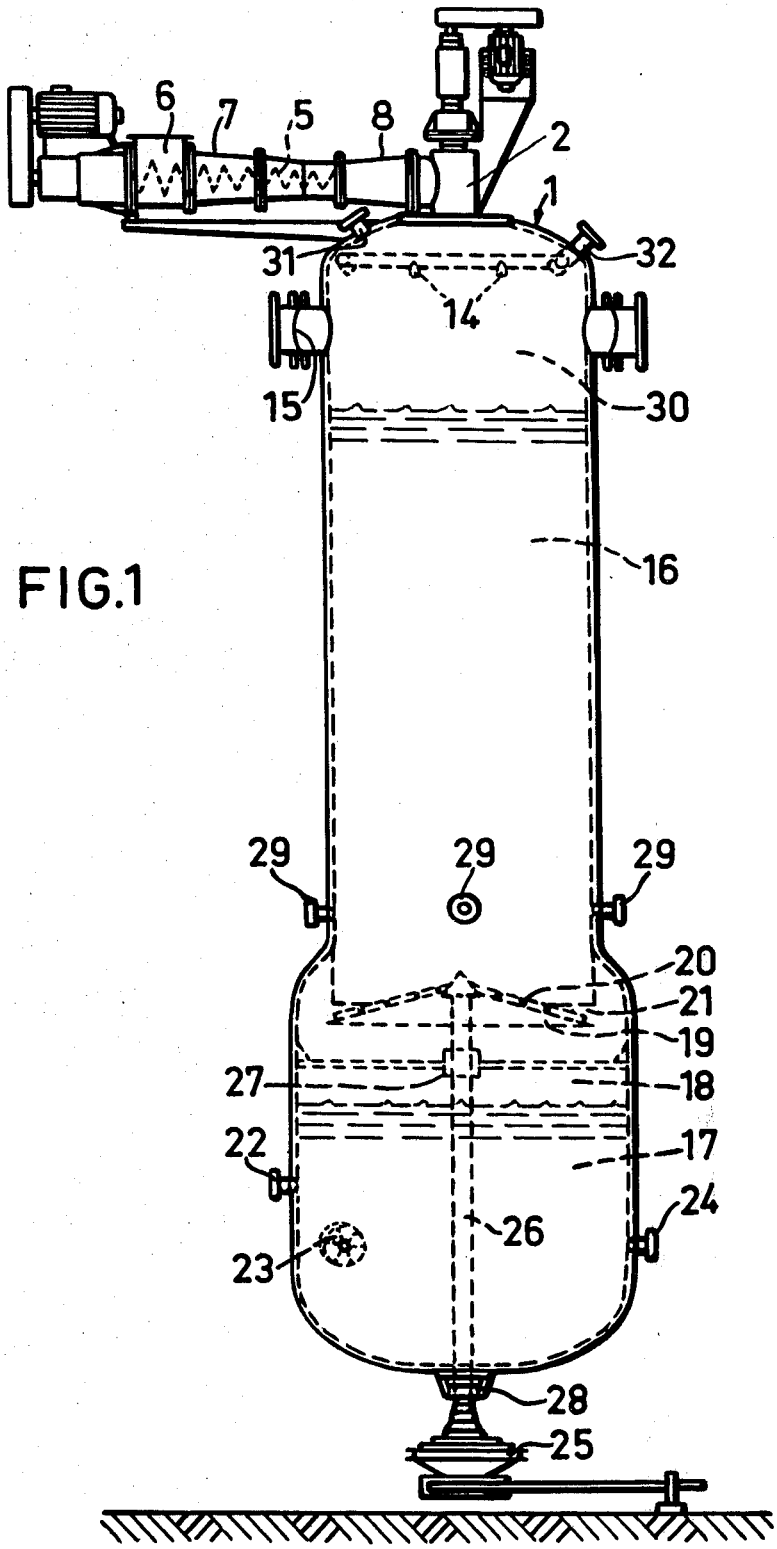

This is a continuation of application Ser. No. 414,341 filed Nov. 9, 1973, now abandoned.

The present invention relates to a method for bleaching fibrous material, particularly cellulose pulp, with a gaseous bleaching agent and is particularly intended for use in such systems where the fibrous material is charged in a finely disintegrated condition to a gas chamber located in the upper portion of a vertical bleaching tower having at least substantial smooth walls, the fibrous material being caused to fall freely under gravity to form a coherent, highly concentrated column of material in the gas chamber. The invention is also concerned with a system for putting the method into effect.

When bleaching pulp with a gaseous bleaching agent in a tower of the type described, the desired reaction time is normally longer than the free fall time of the pulp through the tower, and generally longer than five minutes. Consequently, a column of pulp is formed in the tower, and owing to the weight of overlying pulp layers in the column the volumetric weight of the pulp at the bottom of the column will be greater than that at the top. If the pulp at the bottom of the column is compressed to an excessive degree, difficulties will arise in feeding the requisite quantity of gas to this portion of the pulp and it will be impossible to accomplish the reaction within a reasonable period of time. The pulp located at the bottom of the column is namely subjected to a pressure of such magnitude that water is squeezed from the pulp, thereby rendering it but slightly permeable to the gas, whereby the only manner in which the gas can reach the pulp is by diffusion in liquid phase. This problem can be solved of course by using bleaching towers of larger diameters. Such towers require a lot of space, however, and involve more expensive constructions with respect to apparatus needed to the discharge the pulp from the tower. Attempts have been made to solve the problem by providing the tower with inwardly projecting ledges, which arrest the downward passage of the pulp and from which the pulp is scraped after a suitable reaction period. This involves additional expense for the mechanical devices employed, thereby reducing the economical advantages obtained with the gas phase bleaching process.

It has now been discovered that a continuous gas permeable column of pulp of such height as to permit the tower to have an economic diameter, can be maintained in the tower, provided that the pulp has a "fluffy" texture and is highly concentrated.

When bleaching cellulose pulps with gaseous bleaching agents in accordance with the invention, the pulp should be loosely packed and have a concentration of between 18–40%. A suitable concentration is one between 25 and 35%, although a concentration of 30% is preferred. It will be easily understood that in order for optimum bleaching results to be obtained, the contact surface between the pulp and gaseous bleaching agent should be sufficiently large and that the pulp is sufficiently fluffy to permit fresh gaseous bleaching agent to diffuse into the pulp and replace the consumed bleaching agent. The majority of the bleaching stages applied during the bleaching process can be effected to advantage within the aforementioned concentration range.

The lower limit of the concentration range is determined by construction reasons, since with concentrations below 18% towers with excessive diameters must be used, while the upper limit should not be exceeded for reasons concerning the process. When gas phase bleaching with chlorine or compounds thereof, the highest pulp quality and the highest degree of lignin dissolution is obtained with pulp concentrations in the region of from 30 to 40%. If the gaseous bleaching agent is oxygen gas, however, dry goods contents in excess of 35% constitute a hazardous fire risk and are liable to ignite if for some reason or other the pulp is overheated, or if sparking occurs. Pulp concentrations above 35% are very inflammable and when ignited obtain an explosive character within a short period of time, while pulps of lower concentrations are less inflammable and as a result of their high moisture content are self-extinguishing if ignited. A large number of tests have been made in a tower fitted with bursting plates and pressure and temperature gauges and it has been found in connection therewith that the dangerous limit with respect to the dry goods content of the pulp slurry is from 33 to 35%, varying slightly depending on the partial pressure of the oxygen gas. The limits which can be applied in practice when bleaching pulp with oxygen gas in vertical reaction towers with respect to economic tower diameters and the elimination of fire risk are thus from 25 to 35%. A suitable concentration is 30%.

The aforementioned tests have also shown that in order to permit satisfactory diffusion of gas in the bottom layer of pulp, the maximum height to which the pulp is allowed to build up should be in an approximately rectilinear relationship to the pulp concentration within the range of from 18 to 40%. This functional relationship is illustrated in FIG. 3, which shows the maximum height in meters of the pulp column at different pulp concentrations.

The object of the present invention is therefore to provide a method and a system by means of which pulp can be bleached uniformly and rapidly with a gaseous bleaching agent using relatively inexpensive processing equipment. The method of the invention is mainly characterized by the steps of charging the pulp to the upper portion of an internally smooth or generally smooth reaction tower, i.e., a tower which has no interiorally located ledges or the like for collection pulp and retaining it for desired reaction periods, creating and maintaining a gas filled space in said upper portion, and maintaining in the tower a continuous column of finely disintegrated pulp at a concentration of between 18 – 40% and a maximum height in meters calculated as approximately five tenths to seven tenths, suitably six tenths, of the pulp concentration calculated in percent by weight of the pulp in the coherent column.

Figure 2:
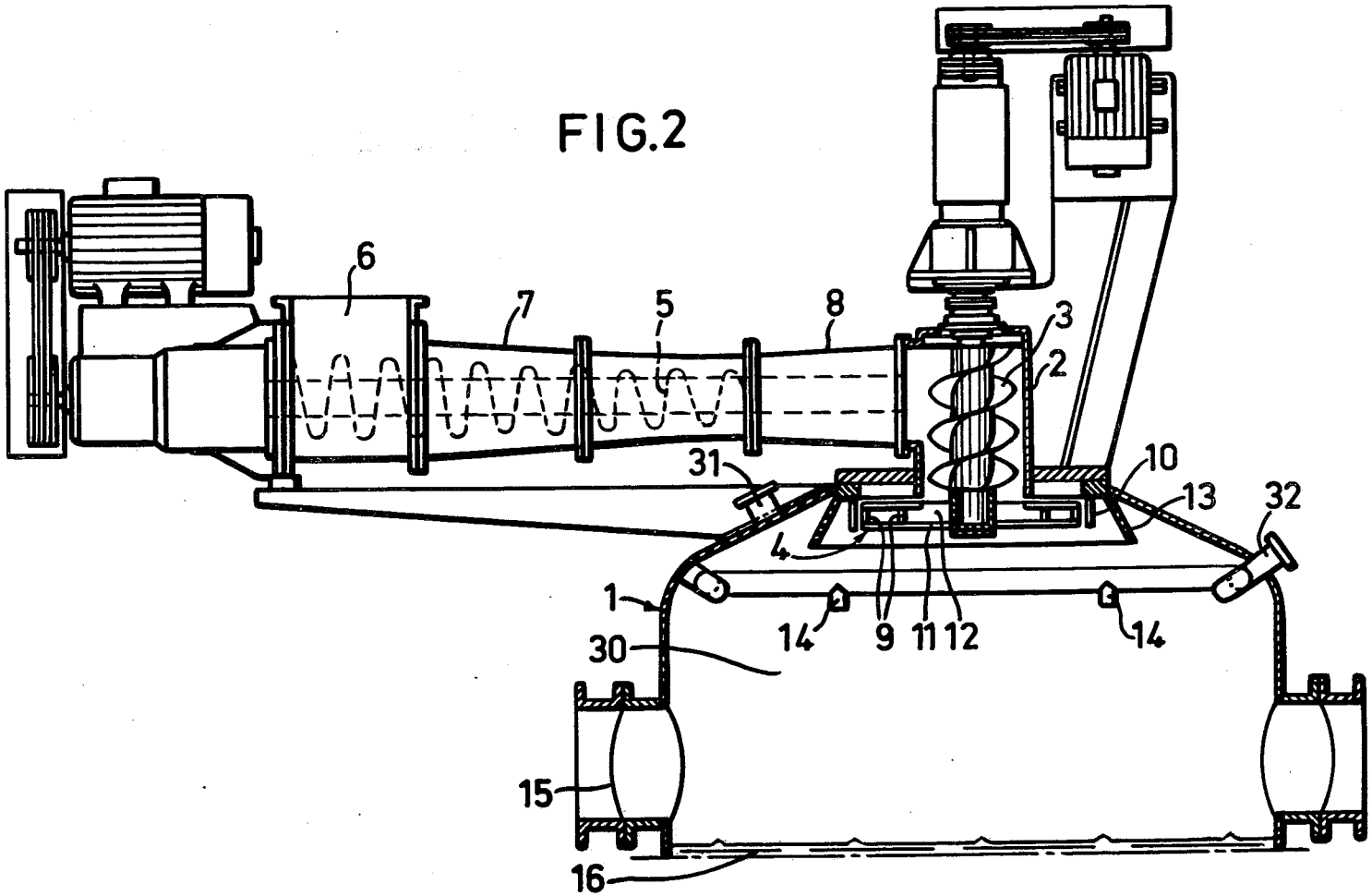
Figure 3:
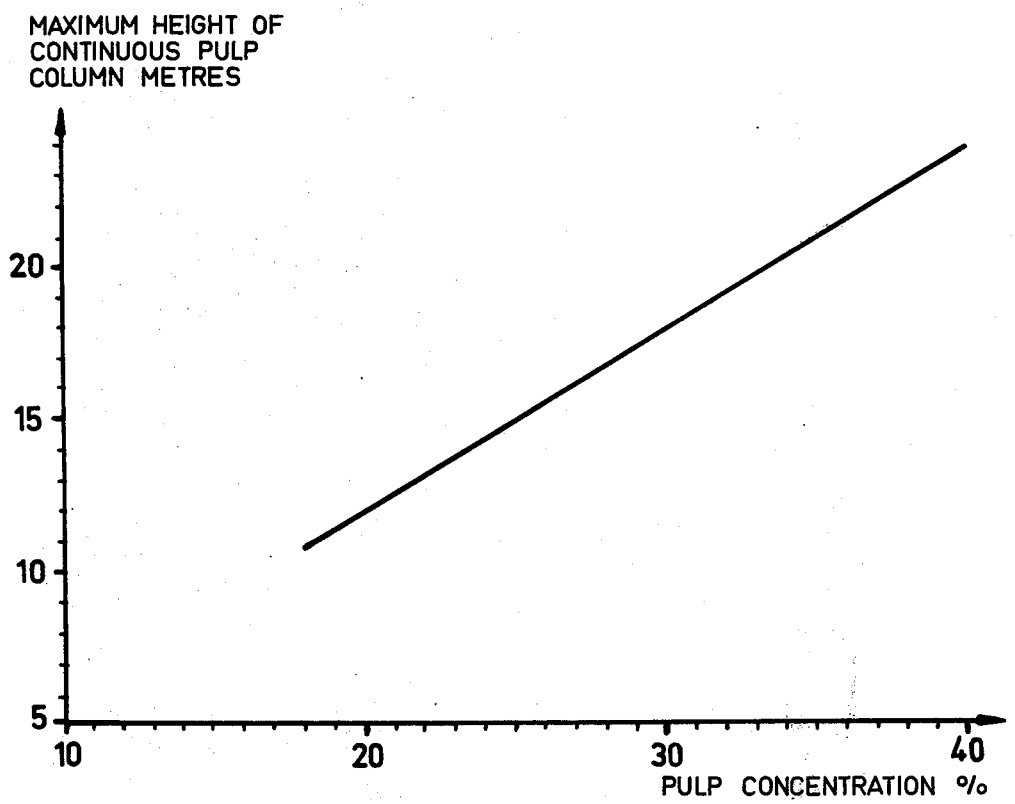
Figure 4:
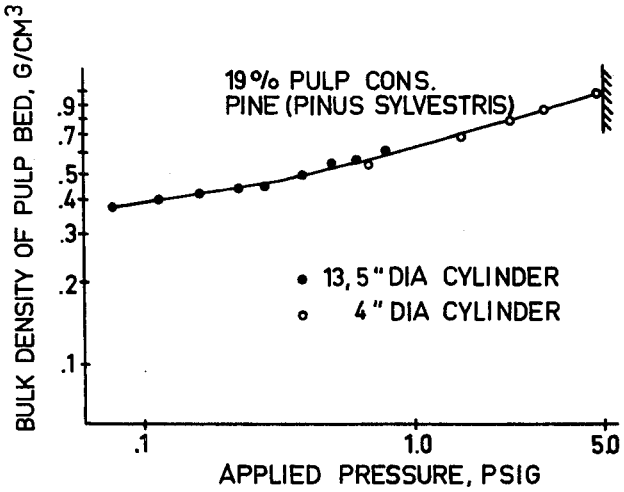
Figure 5:
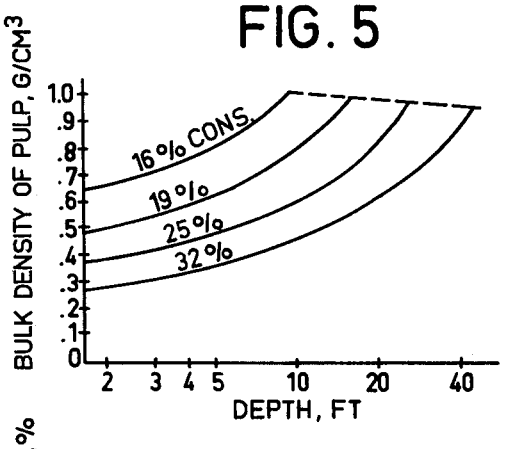
Figure 6:
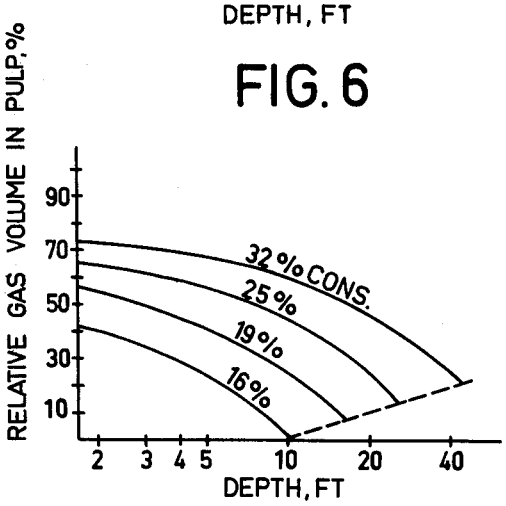
Figure 7:
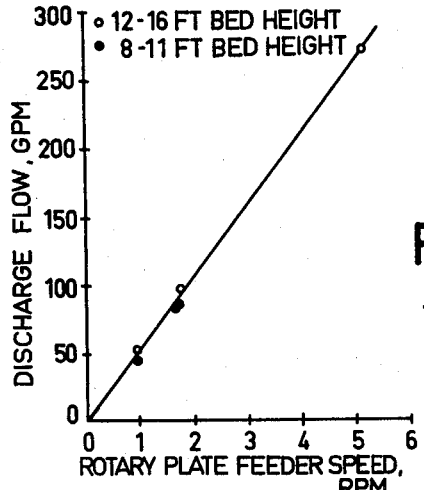
Figure 8:
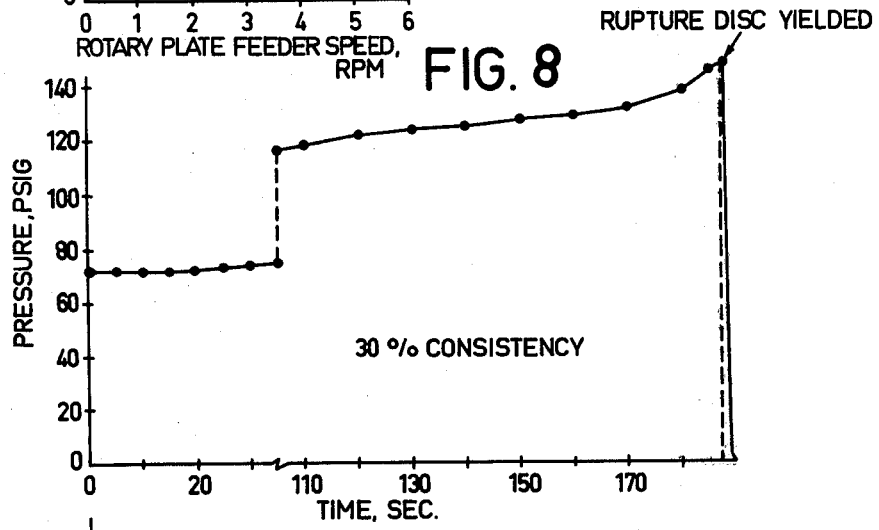
Figure 9:
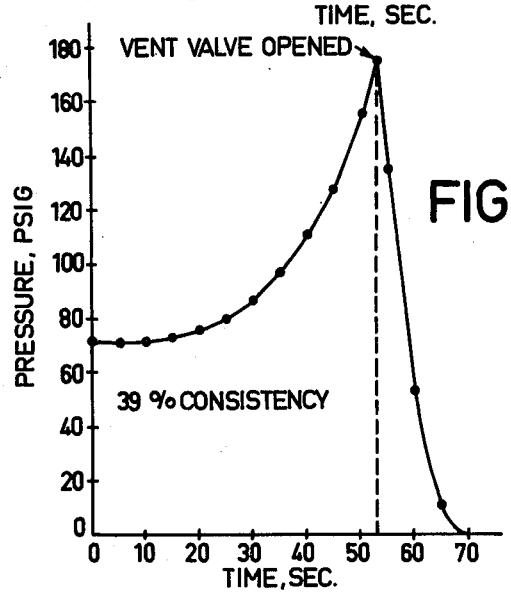
Figure 10:
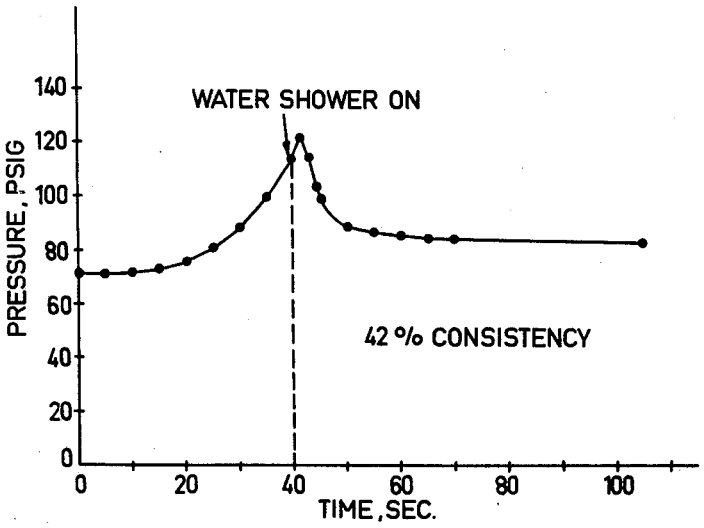
Figure 11:
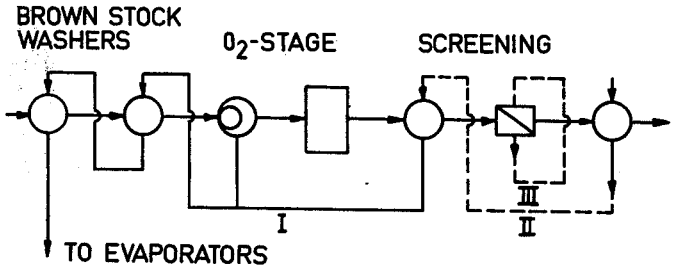
Figure 12:
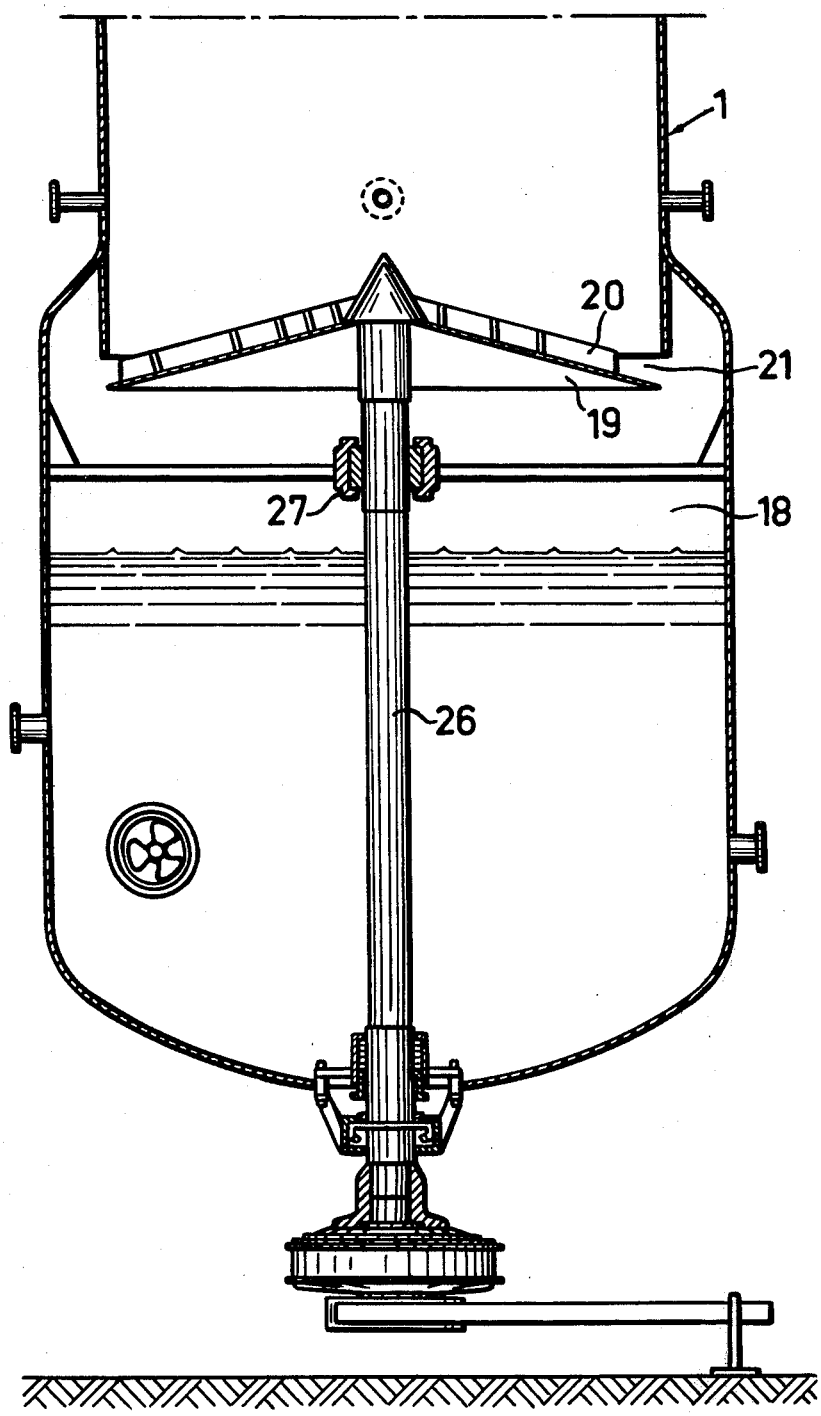

The invention will now be described with reference to the accompanying drawings, of which FIG. 1 illustrates a closed bleaching tower, FIG. 2 illustrates in vertical section and larger scale the upper portion of the tower, FIG. 3 shows the relationship between the maximum height of the column of pulp and the pulp concentration, FIG. 4 shows the relation between the bulk density and the applied pressure in two various cylinders, FIG. 5 shows the bulk density of fluffed pulp as a function of the depth of the pulp column, FIG. 6 shows the relative gas volume in a pulp column as a function of the depth, FIG. 7 shows the discharge flow of the pulp from the bleaching zone to the diluting zone as a function of the speed of the rotatable loose bottom plate, FIGS. 8, 9 and 10 show the pressure in a tank as a function of time after initiating a combustion, FIG. 11 is a flow scheme of a system for recovering the dissolved solids from the oxygen bleaching and FIG. 12 shows the diluting zone in an enlarged scale.

The illustrated bleaching vessel 1 is a down-flow tower having connected to the top thereof a supply line 2 which, as shown in FIG. 2, can be provided with a conveyor screw 3 to ensure that the pulp is fed smoothly down to a device 4, which finally disintegrates the pulp. The screw conveyor 3 and pulp disintegrating device 4 may be conveniently arranged on the same shaft and thus caused to rotate at the same speed. They can, however, also be arranged on different shafts and the screw 3 can be made to rotate at a lower speed than the device 4. The pulp is fed to the line 2 by means of a suitably horizontally arranged screw conveyor 5 having an inlet 6. The screw conveyor 5 is constructed so that a pulp plug is formed therein, thereby preventing the gaseous bleaching agent escaping counter to the feed direction of the pulp. Both the screw 5 and its casing 7 are conical in shape and have a decreasing cross section in the feed direction of the pulp. The conveyor screw system is terminated with portion 8 located close to the line 2. This portion of the screw system may be cylindrical or have an increasing cross section.

The pulp is finely disintegrated by means of cylindrical, rotating pegs 9 or similar rod-shaped members of which at least a number thereof co-operate with stationary members 10 having roughly the same shape. A plate 11 and optionally also a carrier or pusher member 12 are arranged to guide the pulp and to throw the pulp radially outward towards the members 9 and 10. It may also be suitable to deflect the general radial movement of the pulp in a direction obliquely downwards. In the illustrated embodiment, this is effected by means of a stationary conical shield 13. Obviously, the system of the invention is not restricted for use with the shown pulp shredding and loosening device, but other devices known to the art for this purpose can also be used.

The pulp can be treated immediately upon entering the tower or during its passage therethrough. The device, which finely disintegrates the pulp, may also be located externally of the tower, although this requires the provision of means which ensure that the pulp is charged to the tower without loosing its fluffiness to any appreciable extent. If required, certain safety devices can be arranged at the upper portion of the tower, such as sprays 14 for water or other suitable fire extinguishing agents, and bursting plates 15. If bursting plates are used they should be at least two in number and symmetrically arranged so as to prevent harmful reaction forces from occurring in the event of said plates being ruptured. The supply line to the sprays is identified by the reference numeral 32.

The pulp in the lower portion of the tower can be diluted with a liquid discharging from a number of encircling dilution sprays and the pulp can be agitated by means of one or more propeller agitators to provide uniform reduction in pulp concentration to a desired, pumpable consistency. The devices needed to put this into effect need not be described in detail, since they are well known with conventional down-flow bleaching towers. The embodiment illustrated in FIG. 1 has a pulp discharge system which affords the advantage whereby the risk of the pulp dilution zone migrating up the tower is eliminated. In the exemplary embodiment, the tower is divided into a bleaching zone 16, which includes the gas space 30, and a diluting zone 17, the zones being separated by a gas zone 18. The pulp rests in the bleaching zone on a rotatable loose bottom plate 19, which separates the bleaching zone from the gas zone 18 and which has discharge pusher members 20 for discharging the pulp through a slot 21, formed between the loose bottom plate 19 and the walls of the bleaching tower. The pulp then falls down through the gas zone 18, which is maintained just below the loose bottom plate 19, to the diluting zone 17. The suspension is diluted with water (return water) supplied from one or more pipes 22, and stirred by means of propeller agitators 23 whereafter the suspension is discharged at a suitable pumping consistency, for example roughly 4%, through the pipe 24. In the illustrated embodiment, the loose plate 19 is driven by a hydraulic motor 25 and supported by a shaft 26 carried in two bearings 27 and 28.

The dilution zone may extend up to the proximity of the loose plate 19 or to the same level as the plate.

The gaseous bleaching agent is supplied to the bleaching zone through one or more lines 29, suitably at the lower portion of the zone or simultaneously at several levels beneath the level of the pulp in the bleaching zone. Supplied to the gas filled spaces 30 and 18 may also be effected simultaneously, or alternatively to one or both of said gas filled spaces. In the latter instance, direct supply of the gaseous bleaching agent to the pulp may be avoided. Arranged in the upper portion of the tower is a discharge line 31 for continuously or intermittently removing gaseous bleaching agent, to prevent the bleaching agent from being enriched with gas which is unable to react with the pulp. If, for example, oxygen gas is used, although the same applies with other gaseous bleaching agents, difficulties may arise in preventing air from accompanying the pulp. Enrichment of nitrogen gas can be avoided by draining through the line 31. A certain amount of gaseous bleaching agent is lost in this way.

EXPERIMENTS AND RESULTS THEREOF.

Oxygen bleaching is usually performed at the following conditions

Temperature 175°–250° F (80°–120° C)

Oxygen partial pressure 30–115 PSI (2–8 kg/cm²)

Retention time less than one hour

Original laboratory bleaching experiments were performed at 8–16% pulp consistency. Later we presented data to show that good bleaching results could be obtained in the lab even in the 3–6% consistency range.

From the equipment designers point of view the temperature range indicated presented no special problem. Nor did the pressure or the retention time. The lower consistency range, 3–6%, would however require excessive power for agitation in order to ensure a satisfactory and uniform distribution of oxygen throughout the time of reaction. Also the 8–16% range was considered impractible for similar reasons. It was felt that the ideal consistency range would be where the pulp could be fluffed to such a porous state that the gas could penetrate the pulp column in a reactor along its entire length, or at least that the voids between the fibres could hold the oxygen consumed during the time of reaction. If this goal could not be achieved it would be necessary to stir or agitate the pulp during at least part of the time of reaction, thereby rendering a complicated and expensive reactor, potentially subject to a high level of maintenance costs.

Through laboratory experiments with fluffed pulp of various consistencies the relation between the bulk density of the pulp and the pressure applied to the pulp was established at each consistency level. A bed of fluffed pulp was inserted in a vertical cylinder with teflon coated inner walls in order to minimize wall friction. A perforated plate was put on top of the pulp bed and the volume of the bed was measured as various loads were applied to the perforated plate. Two various cylinders with 4 inch and 13½ inch diameter were used. The pulp had been mixed with 3.5% NaOH as calculated on dry pulp prior to the experiments.

FIG. 4 demonstrates a typical result with 19% consistency unbleached kraft pulp (Pinus Sylvestris). It was found that the bulk density — pressure relation for each consistency above about 1 PSIG applied pressure could be approximately described by the expression $$\gamma = \beta\rho^{H}$$

where $\gamma$ = the bulk density, g/cm$^3$ $\rho$ = the pressure applied, PSIG

The coefficient $\beta$ and the exponent H varied with the consistency of the pulp.

With this established relation and general physical-mathematical calculations the bulk density of fluffed pulp was derived as a function of the depth of the bed, (FIG. 5). As can be seen the bulk density increases considerably with the depth. At 25% consistency the bulk density 20 ft below the surface is thus almost twice as high as 3–4 ft below the surface because the pulp is compressed by its own weight. The dashed line represents the limit where the fibre network collapses and dewatering occurs as also established in the experiments.

Assuming the density of the fibres to be 1.6 and the density of water to be 1.0 the relative gas volume in a pulp bed was further calculated as a function of the depth in the bed as illustrated in FIG. 6.

From these graphs one can conclude that gas phase bleaching which requires some significant retention time has to be performed at high consistencies in order to assure a reasonably good penetration of the gas throughout the entire pulp bed if mechanical means of mixing the gas with the pulp during the time of reaction are to be avoided.

It was felt that the appropriate consistency in the reactor with this specific wood specie would be in the 25–30% range. Furthermore the results clearly indicated that it would be possible to perform oxygen bleaching in non agitated beds even at such large production rates as 800–1000 TPD.

With birch (*Betula pubescens*) kraft pulp, results very close to the ones mentioned were obtained. With other wood species different bulk densities may be found. In such cases a satisfactory gas penetration may thus require a somewhat different consistency range.

Another problem which needed attention was how to avoid excessive gas leakage (oxygen leakage) from the feed and discharge ends of the pressurized reactor.

For the feed end a screw feeder (FIG. 2) was designed in such a way that it would compress the pulp to a gas tight plug in the reactor feed pipe line. A prototype was tested in semi-pilot plant scale. After some modifications it proved possible to feed high consistency pulp into a 350 cuft pressurized tank, stop the screw feeder, leave it as it was and find that the next day the pressure in the tank was exactly the same as when the feeder was stopped the day before.

The obvious way to prevent excessive gas losses at the discharge end is to operate with a dilution zone in the bottom of the reactor. Theoretically at 212° F (100° C), 85 PSI (6 kg/cm$^2$) and 4% blow consistency the oxygen loss with the blow liquor would amount to 0.4% as calculated on the pulp and 0.25% at 6% blow consistency provided equilibrium exists between the gas phase and the liquid phase.

It was thus decided to design the bottom part of the reactor as shown in FIG. 12. A rotary plate feeder discharges the high consistency pulp into a dilution zone. With this arrangement a very precise control of the discharge flow from the high consistency zone is achieved as illustrated by FIG. 7. By maintaining a controlled level in the dilution zone the precision discharge is transferred to the blow line.

Any operation in which pure oxygen is involved presents certain risks. Therefore a study of the safety aspects of oxygen bleaching was started at an early stage of the development work. Extensive tests have thus been performed both in the lab and in semi-technical scale in order to find boundary conditions for ignition and combustion of the pulp at various combinations of pulp consistency and oxygen partial pressure. Rather sophisticated equipment was used in order to continuously measure and record rapid pressure and temperature changes. In all experiments the following technique was used.

A bed of fluffed pulp was inserted in a pressure vessel equipped with an electrically heated filament which was used to start ignition. Oxygen was supplied to the starting pressure desired and the filament was heated to ignite the content. Vessels of various sizes were used from a 0.3 liter autoclave to a 350 cuft pressure tank.

In summary it turned out to be very difficult to ignite pulp at or below 30% consistency even in pure oxygen at 140 PSIG (10 kg/cm$^2$). Combustion could however be initiated by placing a small amount of 38–40% consistency pulp around the filament. FIG. 8 shows a typical pressure versus time curve when using this technique in the 350 cuft tank.

In that experiment 65 lbs BD pulp of 30% BD consistency was inserted in the tank together with 12 lbs of 38% consistency pulp around the filament which was positioned at the surface of the bed. Starting pressure was 71 PSIG (5 kg/cm$^2$). The point of ignition in the graph is at zero time. As can be seen the pressure increased very slowly during the first 35 seconds. As no attempts were made to prevent further combustion the rupture disc finally yielded at 150 PSIG (10.5 kg/cm$^2$) after about 3 minutes.

FIG. 9 shows the result of another test when 33 lbs BD pulp of 39% consistency was ignited in the same vessel. Also here the pressure increase was relatively modest during the first 30 seconds, rising from 71 PSIG to about 85 PSIG. At 176 PSIG a 4 inch diameter vent valve was opened which lowered the pressure to zero in 17 seconds and put out the fire.

In all experiments it had been observed that combustion occurred on the surface of the pulp bed only. It was thus felt that it would be possible to quench a fire once it had started with a shower rather than open a safety valve or blow a rupture disc. FIG. 10 demonstrates the effect of a shower in the 350 cuft tank. In that test 45 lbs BD pulp of 42% consistency was ignited at a starting pressure of 71 PSIG. After 40 seconds at 114 PSIG the shower valve was opened and the pressure decreased to the 85 PSIG level in 10–15 seconds as the fire was extinguished.

As a result of the safety investigations the reactor was equipped with three independent safety systems. One is initiated by a pressure transmitter and/or temperature transmitters in the reactor. Either one will open a valve in the feed line to a water shower in the top of the reactor, open a vent valve for quick pressure release and close a valve in the oxygen feed line in case a fire starts. The second system is simply a conventional mechanical safety valve and the third one consists of two rupture discs. The three safety systems will start to operate at successively higher pressures. Either system will stop a fire and decrease the pressure and the temperature before it has reached anywhere near a dangerous level.

Oxygen bleaching alone does not decrease pollution to any considerable extent unless the dissolved solids from the oxygen stage are recovered in some way or the other.

It is possible to perform oxygen bleaching with a certain amount of black liquor solids present in the pulp.

This fact leads to the concept of a truly countercurrent recovery system where the recovery liquor from the oxygen stage is used for washing on the last brown stock washer.

In FIG. 11 such an arrangement is shown in three alternatives. For the sake of simplicity internal dilution circuits are not shown. The flow scheme does however represent recovery conditions which allow a completely balanced liquor system, i.e., no liquor stream has to be diverted to the sewer or elsewhere. In alternative I the screening system is open. All excess liquor from the washer after the oxygen reactor is used as wash liquor on the last brown stock washer. Screening (not including deknotting) is made after the oxygen stage. In this way the oxygen stage becomes an integral part of a brown stock washing system where the last washer is the one after the oxygen reactor.

In alternative II the screening system is closed which means that the filtrate from the screened stock decker is used not only for internal dilution in the screening system but also for washing on the washer after the oxygen reactor. Consequently fresh water is used for washing on the screened stock decker which then in fact becomes the last washer in a brown stock washing system with the oxygen stage and the screening system as integral parts.

In alternative III finally the screening reject is also retained within the system by refining the reject and returning it to the primary screens. The excess liquor from the rejects handling system is reused within the screen room.

The degree of recovery of dissolved solids from the oxygen stage has been calculated for the various alternatives mentioned. The calculations have been made at washer displacement ratios 0.70 as well as 0.85 in order to demonstrate the effect of this variable. In all cases the calculations are based on dilution factor 3. The results are as follows

| | % recovered solids at DF 3 | | |
|---|---|---|---|
| | Alt. I | Alt. II | Alt. III |
| DR 0.70 | 64 | 83 | 88 |
| DR 0.85 | 77 | 90 | 95 |

It is thus possible to recover 80–90% of the dissolved solids from the oxygen stage without any additional dilution of the black liquor to the evaporators as compared with practice of today in most brown stock washing systems. This means that the BOD and COD load from a bleach plant effluent will be reduced correspondingly. So will also the colour of the effluent. It further means that sodium hydroxide equivalent to 85–95 lbs of salt cake per ton of pulp will be recovered from the oxygen bleaching stage.

The invention is not restricted to the illustrated embodiments, but can be modified within the scope of the following claims.

Thus, the pulp may be moved through the tower in a direction from the bottom to the top thereof, by means of appropriate devices. Neither is the invention restricted to the illustrated devices used to charge and to remove the pulp from the tower, but other appropriate devices may also be used to feed the pulp at the rate required to remove said pulp at specific intervals, which ensure that the maximum height of the pulp column falls within the range taught by the concept of the invention.

We claim:

1. A continuous method for countercurrently bleaching high consistency cellulose pulp with oxygen, which comprises introducing the pulp in disintegrated and fluffed condition into a space at the top of a substantially internally smooth pressurized reaction tower;

introducing oxygen into the lower portion of said tower;

maintaining a gas-permeable column of finely disintegrated and fluffy pulp at a consistency of 25–35% by weight below the space at the top of the tower, which space contains oxygen;

bleeding gas from the space at the top of the tower to avoid enrichment of the space with gas unable to react with the pulp;

establishing and maintaining a reaction temperature of 80°–120° C. for the contents of the tower;

maintaining a maximum height, measured in meters, of five tenths of the maintained pulp consistency, measured in percent, of said column of finely disintegrated and fluffy pulp of high consistency; and discharging bleached pulp from the bottom of the tower.

2. A method as claimed in claim 1, wherein the pulp is subjected to fine disintegration and fluffing as it enters the space at the top of the tower and is showered down, through said space, onto the upper surface of a continuous column of disintegrated and fluffed pulp maintained in the tower.

3. A method as claimed in claim 1, wherein the column of pulp of high consistency extends downwards to a bottom element being located above the bottom of the tower, and bleached pulp is discharged from said bottom element in substantially an undiluted state into a dilution zone at the bottom of the tower beneath said bottom element and whereby diluted bleached pulp is discharged from said dilution zone.

* * * * *

UNITED STATES PATENT AND TRADEMARK OFFICE

CERTIFICATE OF CORRECTION

PATENT NO. : 4,022,654

DATED : May 10, 1977

INVENTOR(S) : Hans-Erik Rye Engstrom; Bengt Edvard Pettersson

It is certified that error appears in the above—identified patent and that said Letters Patent is hereby corrected as shown below:

At page 1, column 1, the related U.S. application data should appear as follows:

Continuation of Ser. No. 414,341, November 9, 1973, abandoned, which is a continuation of Ser. No. 156,287, June 24, 1971, abandoned.

Signed and Sealed this

*Seventh* Day of *September 1982*

[SEAL]

*Attest:*

GERALD J. MOSSINGHOFF

*Attesting Officer*

*Commissioner of Patents and Trademarks*